US007944430B2

(12) United States Patent
Jung et al.

(10) Patent No.: US 7,944,430 B2
(45) Date of Patent: May 17, 2011

(54) METHOD AND APPARATUS FOR ADJUSTING BACKLIGHT BRIGHTNESS

(75) Inventors: Hye-Dong Jung, Seoul (KR); Kyung Sun Ham, Yongin-si (KR); Ki-Man Jeon, Seongnam-si (KR); Hyung-Su Lee, Seoul (KR)

(73) Assignee: Korea Electronics Technology Institute, Kyunggi-Do (KR)

( * ) Notice: Subject to any disclaimer, the term of this patent is extended or adjusted under 35 U.S.C. 154(b) by 911 days.

(21) Appl. No.: 11/856,345

(22) Filed: Sep. 17, 2007

(65) Prior Publication Data

US 2009/0028460 A1 Jan. 29, 2009

(30) Foreign Application Priority Data

Jul. 27, 2007 (KR) ..... 10-2007-0075819

(51) Int. Cl.
*G09G 3/36* (2006.01)

(52) U.S. Cl. ..... 345/102; 345/87

(58) Field of Classification Search ..... 345/76–104
See application file for complete search history.

(56) References Cited

U.S. PATENT DOCUMENTS

| | | | | |
|---|---|---|---|---|
| 7,505,024 | B2 * | 3/2009 | Yoo et al. | 345/102 |
| 2001/0052891 | A1 * | 12/2001 | Yoshihara et al. | 345/102 |
| 2004/0246275 | A1 * | 12/2004 | Yoshihara et al. | 345/690 |
| 2004/0257329 | A1 * | 12/2004 | Park et al. | 345/102 |
| 2005/0073495 | A1 * | 4/2005 | Harbers et al. | 345/102 |
| 2005/0078081 | A1 * | 4/2005 | Oda et al. | 345/102 |
| 2005/0184952 | A1 * | 8/2005 | Konno et al. | 345/102 |
| 2006/0097968 | A1 * | 5/2006 | Yamamoto et al. | 345/87 |
| 2006/0119613 | A1 * | 6/2006 | Kerofsky | 345/590 |
| 2006/0214904 | A1 * | 9/2006 | Kimura et al. | 345/102 |
| 2006/0221046 | A1 * | 10/2006 | Sato et al. | 345/102 |
| 2006/0232544 | A1 * | 10/2006 | Sakashita | 345/102 |
| 2006/0238487 | A1 * | 10/2006 | Shih | 345/102 |
| 2006/0279522 | A1 * | 12/2006 | Kurihara | 345/102 |
| 2007/0001997 | A1 * | 1/2007 | Kim et al. | 345/102 |
| 2007/0002000 | A1 * | 1/2007 | Kwon | 345/102 |
| 2007/0152926 | A1 * | 7/2007 | Kwon | 345/82 |
| 2007/0285379 | A1 * | 12/2007 | Jung et al. | 345/102 |
| 2008/0186272 | A1 * | 8/2008 | Huang et al. | 345/102 |
| 2009/0002400 | A1 * | 1/2009 | Ha et al. | 345/690 |

* cited by examiner

*Primary Examiner* — Alexander Eisen
*Assistant Examiner* — Patrick Marinelli
(74) *Attorney, Agent, or Firm* — Edell, Shapiro & Finnan, LLC

(57) ABSTRACT

A method for adjusting backlight brightness for an image display device whose backlights are arranged in an M×N, 2-dimensional array, and an apparatus for realizing this are provided. The method comprises a full search step determining the brightness adjustment value for each of the M×N image blocks corresponding to the backlights for the entire input image and selecting a reference block; a partial search step determining the brightness adjustment value for the selected reference block and surrounding blocks thereof for the image frame inputted following the full search step and reselecting a reference block based on the brightness adjustment value of the previous reference block and surrounding blocks thereof; and an adjustment step adjusting brightness of the backlights in accordance with the brightness adjustment value for each block as determined by the full search step and/or partial search step. In accordance with the present invention, it is possible to increase the speed of image analysis for a display that uses backlights. Likewise, controlling the backlight using the characteristics of the analyzed image enables reducing power consumption and increasing the contrast ratio by applying backlight brightness according to the characteristics of the image.

19 Claims, 5 Drawing Sheets

METHOD AND APPARATUS FOR ADJUSTING BACKLIGHT BRIGHTNESS

CROSS-REFERENCE TO RELATED APPLICATIONS

Pursuant to 35 U.S.C. §119(a), this application claims the benefit of earlier filing data and right of priority to Korean Application No. 75819/2007, filed on Jul. 27, 2007, the contents of which are hereby incorporated by reference herein in their entirely:

BACKGROUND OF THE INVENTION

1. Field of the Invention

The present invention generally relates to displays using backlights, and more particularly to a method and an apparatus for adjusting backlight brightness that capable of reducing the time it takes to adjust backlight brightness according to the brightness of image data.

2. Description of the Related Art

Conventional display devices with backlight consist of the panel part that expresses the image and the backlight part that emits light. Since the panel cannot express the image with sufficient brightness by itself without backlight, light sources such as Cold Cathode Fluorescent Lamp (CCFL), External Electrode Fluorescent Lamp (EEFL), and Light Emitting Diode (LED) are used as backlight to display the panel image.

In general, the display device has the function of adjusting backlight brightness as bright or dark. The function is used to reduce the amount of light in a dark environment and when the backlight is too bright or to increase the amount of light in a bright environment.

A recent trend involves analyzing the image information and increasing backlight brightness if the image is bright and reducing backlight brightness if the image is dark. Such brightness adjustment method reduces unnecessary consumption of the light source and improves image quality.

For example, Korean Patent Publication No. 10-2006-0124132 discloses an LCD display device that adjusts backlight brightness to improve image quality. This LCD display device includes a timing controller that arranges the R, G, and B data signal supplied in frame units by the system and generates a fixed control signal; a data processing unit that generates a fixed amount of brightness voltage for each frame unit using the histogram obtained by analyzing the histogram for the R, G, and B data signal; a backlight controller generating a modulated brightness voltage that was increased or decreased by a fixed step by comparing the brightness voltage for each of the frames; and the backlight that adjusts and generates lights according to the brightness voltage generated by the backlight controller.

Similar to the abovementioned conventional art, the main trend involves adjusting the brightness of the entire backlights for each frame. In this organization, the brightness voltage is changed for each frame that differs by light source. If a lamp source such as CCFL is used, N 1-dimensional partitions are made, and light source brightness is changed for each section.

The reference value of an image for adjusting backlight brightness is analyzed in general with the histogram for such image. Since a histogram adequately expresses the distribution of bright and dark regions in an image, selecting the desired brightness adjustment value is only appropriate. Note, however, that analyzing an image using a histogram requires a computation process for each pixel as well as considerable time.

Therefore, if the conventional method wherein histogram computation is carried out for the entire image is used, and the computation takes a long time, a delay will occur in the display device. In this case, the production cost per unit will increase because a faster chip set needs to be used when manufacturing a chipset that realizes the function.

SUMMARY OF THE INVENTION

Accordingly, one object of the present invention is to address at least the above-noted and other problems.

To achieve these and other advantages and in accordance with the purpose of the present invention as embodied and broadly described herein, the present invention provides a method for shortening the time taken for backlighting and minimizing the cost of the computation chipset by reducing the amount of computation required for adjusting backlight brightness according to the brightness of the data for a display using backlights.

In one aspect of the present invention, a method for adjusting backlight brightness for an image display device is provided. The image display device has backlights are arranged in an M×N, 2-dimensional array. The method comprises a full search step determining the brightness adjustment value for each of the M×N image blocks corresponding to the backlights for the entire input image and selecting a reference block; a partial search step determining the brightness adjustment value for the selected reference block and surrounding blocks thereof for the image frame inputted following the full search step and reselecting a reference block based on the brightness adjustment value of the previous reference block and surrounding blocks thereof; and an adjustment step adjusting brightness of the backlights in accordance with the brightness adjustment value for each block as determined by the full search step and/or partial search step.

Preferably, the full search step is performed for the first input frame and the frame inputted during each preset period; the partial search step is performed for all other inputted frames.

Preferably, the full search step comprises partitioning the input image frame into an M×N, 2-dimensional array to correspond to the M×N array for the backlight; determining the brightness adjustment value for each of the M×N image blocks for the entire image frame; and selecting at least a block that mostly affects the image frame brightness from the M×N image blocks as the reference block.

Preferably, the partial search step comprises determining the brightness adjustment value for each block for only the reference block in the previous frame and the surrounding blocks; selecting a new reference block among the reference block and surrounding blocks; and maintaining the existing brightness adjustment value for blocks other than the reference block and surrounding blocks.

In the other aspect of the present invention, an apparatus for adjusting the brightness of the backlights arranged as an M×N, 2-dimensional array on the rear side of the image display device panel is also provided. The apparatus comprises a brightness analysis means determining the brightness for the expressed image frame; an analysis control means controlling the brightness analysis means such that brightness is analyzed in full for the first frame and frames inputted after a preset period and only in part for the other frames; and a brightness control means controlling the brightness of the M×N backlights based on the results of analysis of the brightness analysis means.

Preferably, the brightness analysis means comprises an image partitioning means partitioning the image into M×N image blocks to correspond to the M×N backlights and a histogram computation means analyzing the brightness for each of the block above.

Preferably, the analysis control means comprises a setup period storage means for saving the preset period; a brightness information storage means for storing the brightness information for each of the M×N image blocks; a reference block selection means that selects at least a reference block from the M×N image blocks; a surrounding block selection means that selects the blocks surrounding the reference block; and an analysis scope determination means that determines the scope of analysis for the brightness analysis means.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

DETAILED DESCRIPTION OF THE PREFERRED EMBODIMENTS

Figure 1:
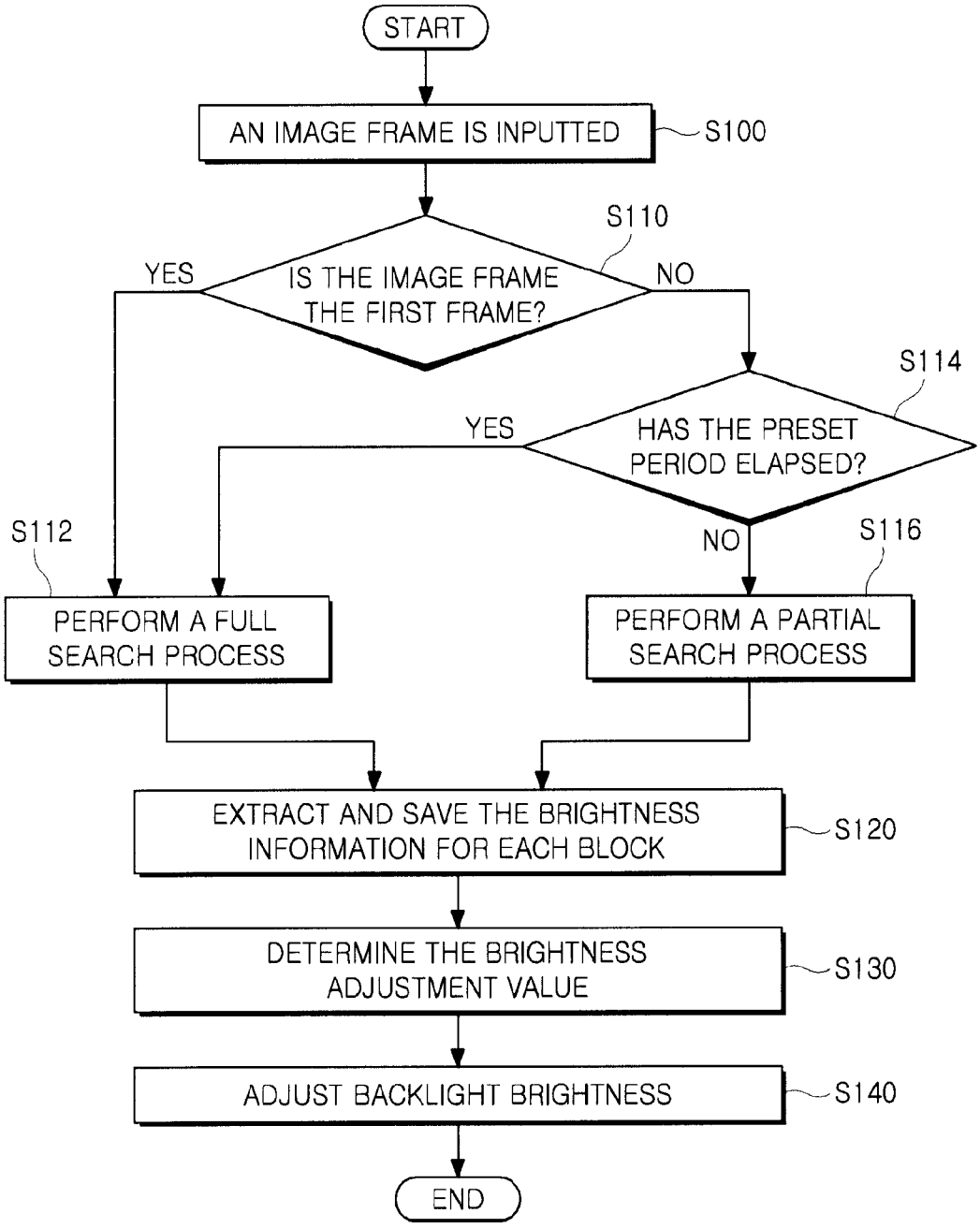
FIG. 1 is a flow chart illustrating a method for adjusting the backlight brightness according to an embodiment of the present invention.

Embodiments of the present invention will now be described more in detail hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

When using a light source such as LED for the backlight, 2-dimensional partitions may be applied. In such case, a superior expression of the contrast ratio and a more detailed brightness control are enabled. The preferred embodiment for the present invention assumes adjusting the brightness for the image display device using backlights arranged in an M×N, 2-dimensional array.

FIG. 1 is a flow chart illustrating an overall process of a method for adjusting backlight brightness for the image display device according to an embodiment of the present invention.

Referring to FIG. 1, when an image frame is inputted (step S100), it is verified whether the image frame is the first frame or not (step S110). If the image frame is the first frame, the brightness information is calculated by the search process for the entire input frame (step S112). At this time, the image frame is partitioned into M×N image blocks arranged in a 2-dimensional array to correspond to the backlight array and calculated for each block unit.

Next, brightness information is extracted by block unit and saved (step S120).

Based on the brightness information for each block, brightness adjustment value is determined for each backlight corresponding to each block (step S130); backlight brightness is then adjusted using the determined brightness adjustment value (step S140).

According to the advanced technology of this invention, brightness for the following frames is found for only part of the image frame while the initial input frame goes through the abovementioned process; backlight brightness is then adjusted using this information (step S140).

Therefore, the amount of computation for the backlight brightness adjustment value can be reduced significantly, and an improvement in the computation speed and reduction in unit price for the computation processing chipset, attempted.

In other words, if it is not a first frame, and the preset period has not lapsed according to the step S114 that judges whether the preset period has lapsed or not, partial search wherein brightness is determined for only part of an image frame is performed (step S116), and then the steps S120 to S140 are performed.

If only partial search is executed continuously for several times, brightness information processing for a scene change, or an image appearing unexpectedly may not be carried out appropriately. Once the preset period is reached, it is preferable to carry out full search again (step S112).

The preset period may be a time period or a frame period. Since the number of frames processed per second is constant, no actual difference exists between the two except whether a timer or a frame counter is used to calculate the period.

The full search process and partial search process shall be examined in more detail.

Figure 2:
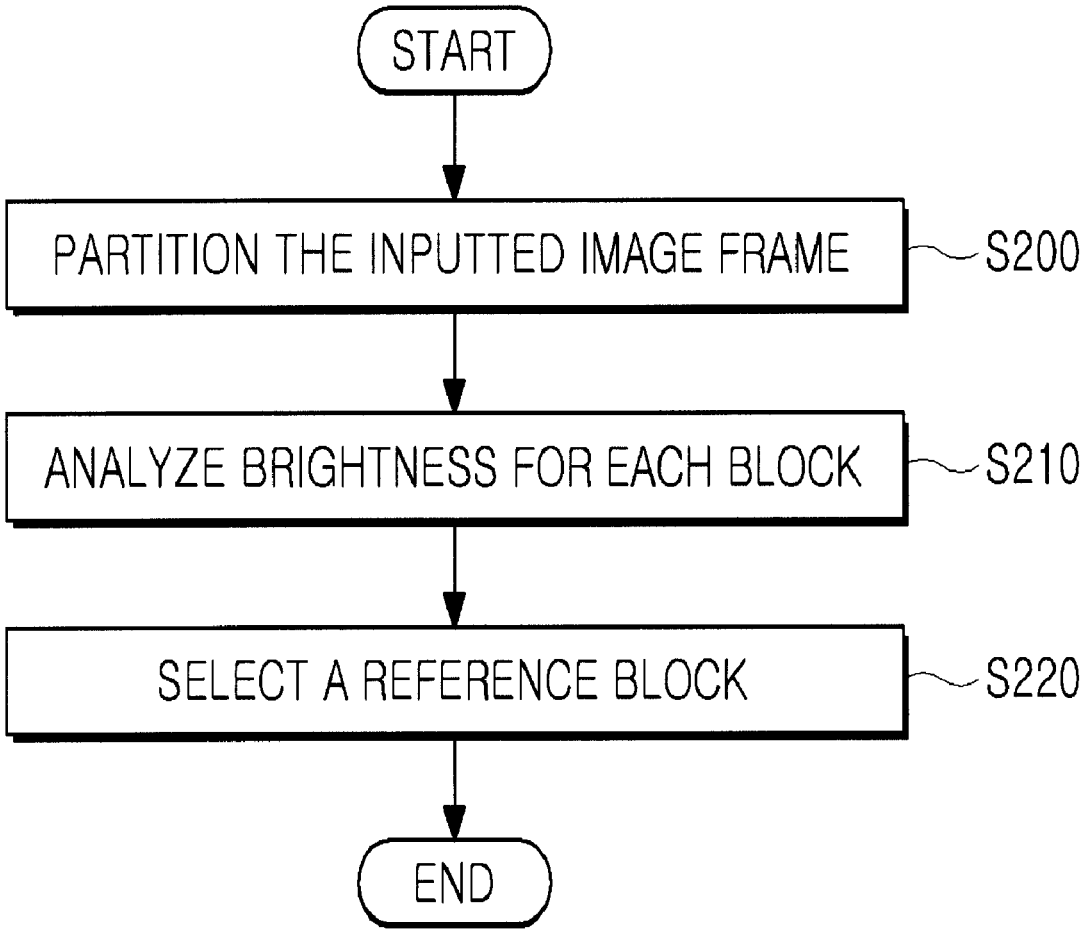
FIG. 2 is a flowchart that specifically illustrates the full search process originating in FIG. 1 according to an embodiment of the present invention.

FIG. 2 is a flow chart illustrating the full search process according to an embodiment of the present invention.

Referring to FIG. 2, the inputted image frame is partitioned into a number of image blocks (step S200). Each block is partitioned such that there is mutual correspondence with the backlight light source arranged in an M×N, 2-dimensional array.

When the partition is completed, the brightness for each partitioned block is analyzed (step S210). The brightness information may be obtained by analyzing the histogram for the block. The histogram is a graph displayed by analyzing how many pixels are there with labels between 0 and 255 for each of the R, G, and B channels. The brightness information and color information may be obtained through the histogram of an image.

When the analysis is completed, a reference block is selected from the blocks making up the frame (step S220). A block that may affect the overall brightness of the currently analyzed frame is set up as the reference block and saved.

For example, at least one block whose brightness, color, or change in motion exceeds a predetermined threshold value or the block with the highest brightness, color, or change in motion may be selected as the reference block.

For other references, at least one block whose brightness exceeds a predetermined threshold value or the block with the highest brightness may be selected as the reference block.

As a different reference, at least one block whose brightness exceeds that of the reference block for the previous frame may also be selected as the reference block.

Aside from the references described above, the reference block may be selected with a reference that can determine the overall brightness of the image frame.

In the full search process, brightness information analysis is performed for all M×N image blocks. For example, a method of gathering the brightness information of an image such as a method of analyzing an image using the histogram is accompanied by a computation process for each pixel. In this case, the full search process will require considerable computation time.

Therefore, in the present invention, partial search shall be performed for most of the inputted frames wherein only a specific part is analyzed instead of performing a brightness information analysis for all the blocks to shorten the computation time.

Figure 3:
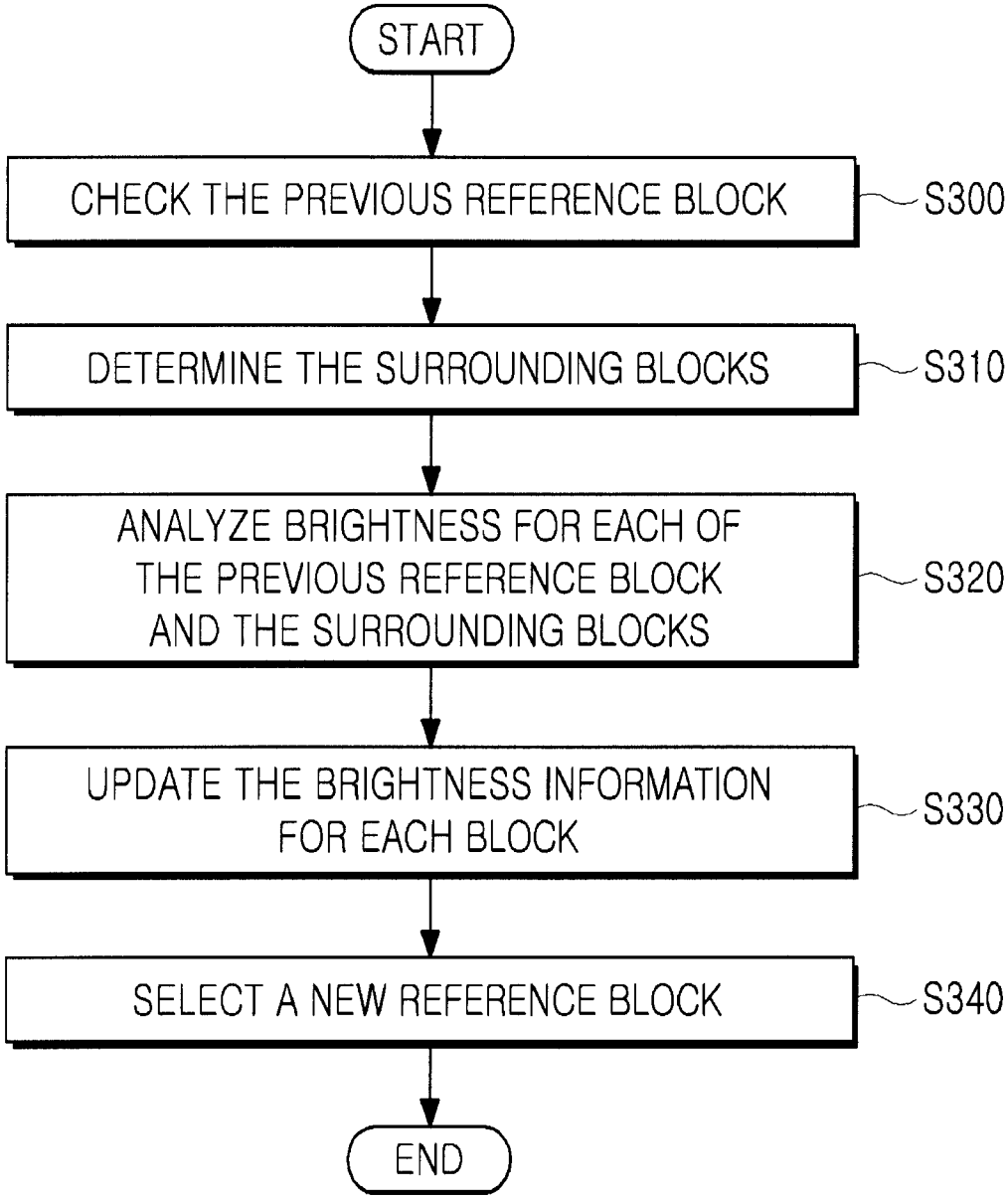
FIG. 3 is a flowchart that specifically illustrates the partial search process originating in FIG. 1 according to an embodiment of the present invention.

FIG. 3 is a flow chart that illustrates the partial search process according to an embodiment of the present invention.

Referring to FIG. 3, the reference block selected in the previous frame may be checked (step S300). To check the reference block, preferably the location and brightness information of the previous reference block may be saved in the memory.

When the checking is completed, the blocks surrounding the reference block may be selected (step S310). Surrounding blocks comprise blocks connecting to and surrounding the reference block. If necessary, i.e., for a sports match image that is large and fast, the number of surrounding blocks may be increased.

When the surrounding blocks selection is completed, brightness information analysis for both the reference block and the surrounding blocks may be executed (step S320); depending on the result, the brightness information for each block may be updated and saved (step S330). At this time, the brightness information value for the previous frame may be maintained in all blocks other than the reference block and the surrounding blocks, with the brightness information for only the reference block and surrounding blocks updated.

Finally, the process of selecting a new reference block may be executed (step S340). In other words, based on the brightness information for each block updated in the partial search process, the reference block for the current frame can be selected for use as the reference block during the partial search for the next frame.

As mentioned earlier, full search is only performed for the first frame, and partial search, for the following frames. This is because the inherent characteristic of moving images is used, i.e., there is little difference between the previous frame and the current frame of an image.

Therefore, for frames inputted after a full search is executed for the first frame and the reference block is selected, valid brightness information for the entire frame can still be obtained even with the execution of partial search and reduced volume of computation.

If such process is applied continuously, however, errors may be accumulated, and any unexpected change in brightness for a changing scene or highlighted sports image that is dynamic may not be properly processed. Thus, executing full search for each preset period is recommended.

Figure 4:
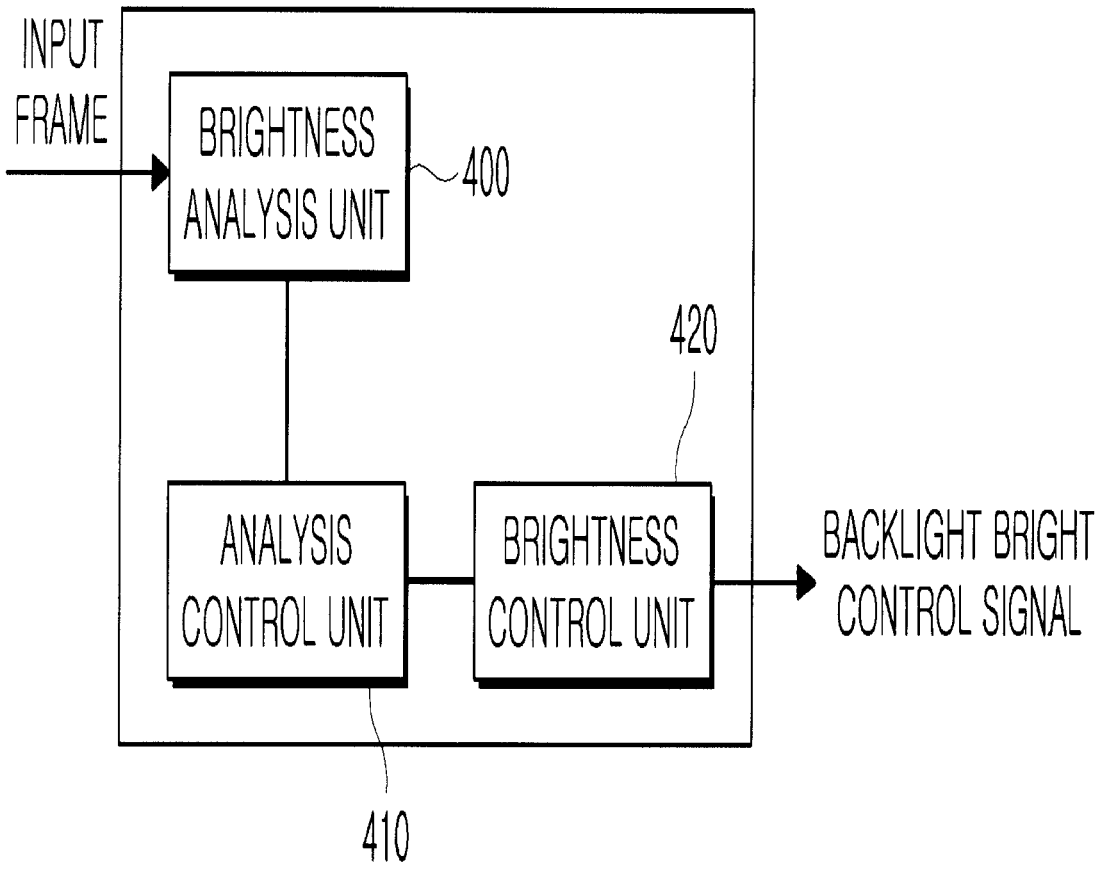
FIG. 4 is an organization diagram illustrating an apparatus for adjusting the backlight brightness according to the other embodiment of the present invention.
Figure 5:
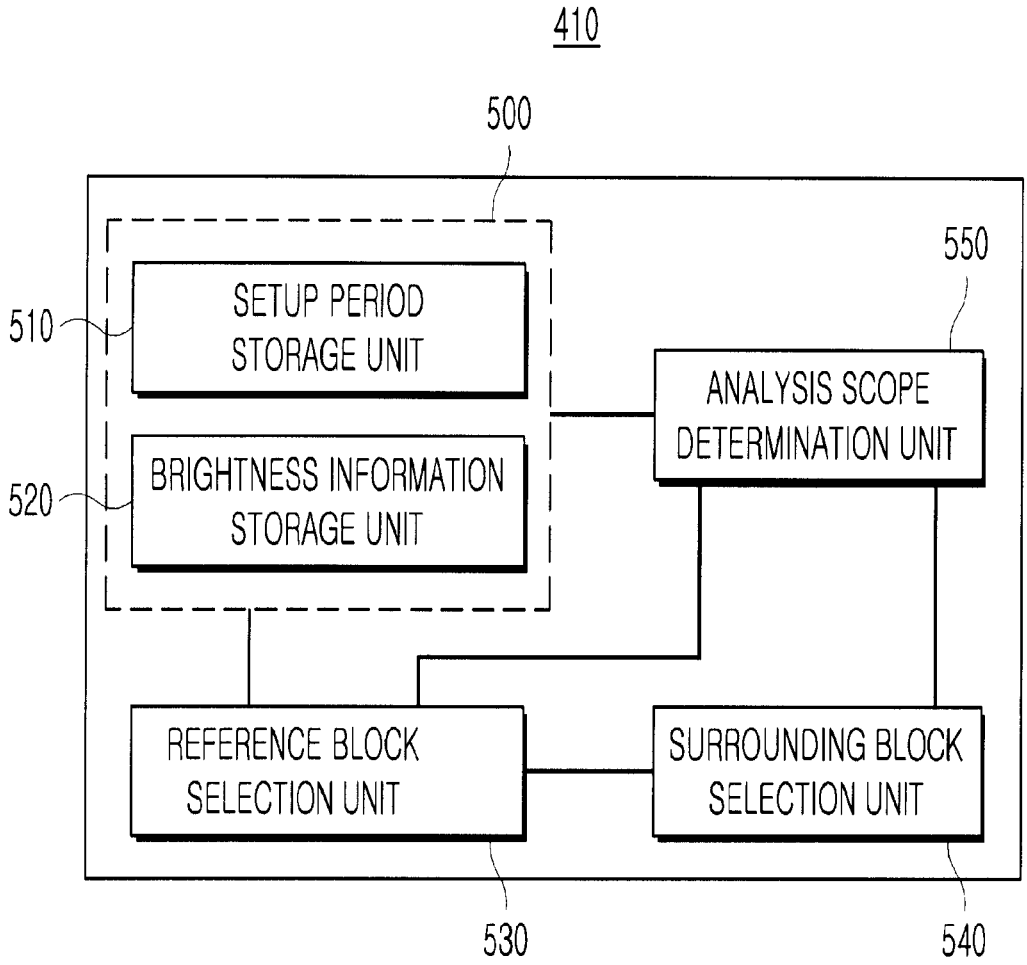
FIG. 5 is an organization diagram that specifically illustrates the organization for the analysis control unit in FIG. 4 according to the other embodiment of the present invention.

FIGS. 4 and 5 are organization diagrams illustrating an apparatus for adjusting the backlight brightness according to the other embodiment of the present invention.

The apparatus comprises a brightness analysis unit 400, an analysis control unit 410, and a brightness control unit 420.

The brightness analysis unit 400 comprises an image partitioning unit (not illustrated) that partitions the image into M×N image blocks to correspond to the M×N backlights and a histogram computation unit (not illustrated) that analyzes the brightness for each of the block above and calculates the brightness information for each block.

The analysis control unit 410 controls the brightness analysis unit 400 such that brightness is analyzed in full for the first inputted frame and frames inputted after a preset period and only in part for the other frames.

The analysis control unit 410 comprises a setup period storage unit 510 for saving the preset period; a brightness information storage unit 520 for storing the brightness information for each of the M×N image blocks; a reference block selection unit 530 that selects more than one reference block from the blocks; a surrounding block selection unit 540 that selects the blocks surrounding the reference block; and an analysis scope determination unit 550 that determines the scope for the brightness analysis unit.

The setup period storage unit 510 and brightness information storage unit 520 may use either a single memory 500 as illustrated in FIG. 5 or separate memories.

The brightness information storage unit 520 updates and saves the brightness information for the block selected by the analysis scope determination unit 550. For other blocks, however, the previous value is maintained.

The analysis scope determination unit 550 controls the brightness analysis unit 400 to calculate the brightness information for the entire block for the first inputted frame. For the succeeding frames, the brightness analysis unit 400 is controlled such that brightness information is calculated for the reference block and surrounding blocks. For each period saved in the setup period storage unit 510, however, the brightness analysis unit 400 is controlled such that brightness information is calculated for the entire block.

The reference block selection unit 530 selects the reference block according to the abovementioned reference block selection rule.

The brightness control unit 420 calculates the brightness adjustment value based on the brightness information for each block saved in the brightness information storage unit 520. It then controls the brightness of the backlight corresponding to each block.

As so far described, a method and an apparatus for adjusting backlight brightness in accordance with the present invention can accelerate image analysis for the display using backlights. On the other hand, according to the present invention, it is possible to reduce power consumption by controlling the backlight using the characteristics of the analyzed image, and to increase contrast ratio by applying backlight brightness according to the image characteristics.

Moreover, the present invention is expected to be used heavily since it can be added to existing image processors easily.

The organization of this invention was described in detail using the preferred embodiment for this invention. Note, however, that this is only an illustration; there may be various variations and modification within the technical aspect of this invention.

For example, the method and apparatus for adjusting backlight brightness in accordance with the present invention may be used independently as well as added to the existing image improvement algorithm. It can be used in all image output display systems with a light source unit whose brightness can be adjusted from a small display to a large display. In addition, the brightness analysis unit, the analysis control unit, and the brightness control unit are functional classifications that may be implemented as one chip or as separate physical devices and may even be partitioned further.

Note, however, that all such changes or other equal changes shall be assumed to be within the technical aspects of this invention. Therefore, the scope of rights for this invention should be determined by the application of the patent application scope.

What is claimed is:

1. A method for adjusting backlight brightness in an image display device having a number of backlights arranged as an M×N, 2-dimensional array, the method comprising:

a full search step determining the brightness adjustment value for each of the M×N image blocks corresponding to the number of backlights arranged as a M×N, 2-dimensional array, for the entire input image and selecting a reference block;

a partial search step determining the brightness adjustment value for the selected reference block and surrounding blocks thereof for the image frame inputted following the full search step and reselecting a reference block based on the brightness adjustment value of the previous reference block and surrounding blocks thereof;

an adjustment step adjusting brightness of the backlights in accordance with the brightness adjustment value for each block as determined by the full search step and adjusting brightness of the backlights in accordance with the brightness adjustment value for each reference block and surrounding blocks thereof as determined by the partial search step;

wherein the full search step is performed for only the first input frame and the frame inputted during each preset period;

wherein the partial search step is performed for all other inputted frames;

wherein the number of blocks adjusted for brightness determined in the partial search step is less than the number of blocks adjusted for brightness as determined in the full search step.

2. The method of claim 1, wherein the full search step comprising:

partitioning the input image frame into an M×N, 2-dimensional array to correspond to the M×N array for the backlight;

determining the brightness adjustment value for each of the M×N image blocks for the entire image frame; and selecting at least one block that mostly affects the image frame brightness from the M×N image blocks as the reference block.

3. The method of claim 1, the partial search step comprising:

determining the brightness adjustment value for each block for only the reference block in the previous frame and the surrounding blocks;

selecting a new reference block among the reference block and surrounding blocks; and maintaining the existing brightness adjustment value for blocks other than the reference block and surrounding blocks.

4. The method of claim 1, the brightness adjustment value for each block is determined based on the histogram for each block.

5. The method of claim 1, the reference block selection and reselection process selects the block with the largest change as the reference block.

6. The method of claim 1, the reference block selection and reselection process selects the brightest block as the reference block.

7. The method of claim 1, the reference block selection and reselection process selects more than one block exceeding the brightness of the reference block for the previous frame as the reference block.

8. An apparatus for adjusting backlight brightness in an image display device having a number of backlights arranged as an M×N, 2-dimensional array on the rear side of the panel, the apparatus comprising:

a brightness analysis means determining the brightness for the inputted image frame;

an image partitioning means partitioning the image into M×N image blocks to correspond to the M×N backlights;

an analysis control means controlling the brightness analysis means such that brightness is analyzed in full for the first frame and frames inputted after a preset period and only in part for the other inputted frames;

and a brightness control means controlling the brightness of the M×N backlights based on the results of analysis of the brightness analysis means, such that the number of M×N backlights controlled based on the results of analysis of the brightness analysis means in full for the first frame and frames inputted after a preset period is greater than the number of M×N backlights controlled based on the results of analysis of the brightness analysis means in part for the other inputted frames.

9. The apparatus of claim 8, the brightness analysis means further comprises of a histogram computation means analyzing the brightness for each of the image blocks.

10. The apparatus of claim 9, the analysis control means comprising:

a setup period storage means for saving the preset period;

a brightness information storage means for storing the brightness information for each of the M×N image blocks;

a reference block selection means that selects at least a reference block from the M×N image blocks;

a surrounding block selection means that selects the blocks surrounding the reference block; and an analysis scope determination means that determines the scope of analysis for the brightness analysis means.

11. The apparatus of claim 10, the reference block selection means selects the block with the largest change as the reference block.

12. The apparatus of claim 10, the reference block selection means selects the brightest block as the reference block.

13. The apparatus of claim 10, the reference block selection means selects at least a block exceeding the brightness of the reference block in the previous frame as the reference block.

14. The apparatus of claim 10, the analysis scope determination means determines all blocks in the frame as analysis targets for the first input frame and frames inputted after a preset period; and for the succeeding frames, only the reference block and surrounding blocks as targets for analysis.

15. The apparatus of claim 10, the brightness information storage means updates and saves the brightness information for the block selected by the analysis scope determination part, and maintains the previous value for other blocks.

16. The apparatus of claim 8, the brightness control means calculates the brightness adjustment value based on the brightness information for each block saved in the brightness information storage means and subsequently controls the brightness of the backlight corresponding to each block.

17. A method for adjusting backlight brightness in an image display device having a number of backlights arranged as an M×N, 2-dimensional array, the method comprising:

inputting a first image frame;

determining a brightness adjustment value for each individual M×N image block of the first frame, wherein each individual M×N image block correspond to individual backlights arranged as an M×N, 2-dimensional array;

adjusting a brightness of each individual backlight according to the corresponding brightness adjustment values;

selecting a reference block from the among the number of M×N image blocks of the first image frame;

inputting a second image frame;

selecting a number of image blocks in the second frame that surround a location of the reference block, such that reference block and the number of surrounding blocks selected is less than the total number of M×N image blocks;

determining a brightness adjustment value for the selected reference block and the surrounding blocks;

adjusting a brightness of each individual backlight according to the brightness adjustment value for the selected reference block and the surrounding blocks;

and reselecting a reference block from the second frame;

wherein the determining of a brightness adjustment value for the each individual M×N image block is done for only the first image frame and for the image frame inputted during each preset period.

18. The method of claim 17, wherein selecting or reselecting the reference block comprises selecting an image block based on at least one of the following: a greatest overall effect on image frame brightness; image block color; a greatest brightest; a greatest change in motion; a brightness that exceeds a predetermined threshold; a change in motion that exceeds a predetermined threshold; a brightness that exceeds a previously selected reference block.

19. The method of claim 17, wherein adjusting a brightness of the individual backlights according to the brightness adjustment values for the selected reference block and the surrounding blocks comprises maintaining existing brightness adjustment values for blocks other than the reference block and the surrounding blocks.

* * * * *